US005975759A

United States Patent [19]

Renaud

[11] Patent Number: 5,975,759

[45] **Date of Patent: *Nov. 2, 1999**

[54] FLEXIBLE FABRIC CONTAINER

[76] Inventor: Jean-Jacques Renaud, 1001 Autumn Woods La. #111, Virginia Beach, Va. 23454

[ * ] Notice: This patent is subject to a terminal disclaimer.

[21] Appl. No.: 08/941,368

[22] Filed: Sep. 30, 1997

Related U.S. Application Data

[62] Division of application No. 08/733,987, Oct. 18, 1996, Pat. No. 5,738,443.

[51] Int. Cl.[6] ..... B65D 30/04; B65D 33/14; B65D 33/36

[52] U.S. Cl. ..... 383/22; 53/459; 141/10; 141/114; 383/33; 383/67

[58] Field of Search ..... 141/10, 114, 313; 53/459, 469; 383/33, 67, 22

[56] References Cited

U.S. PATENT DOCUMENTS

| | | | |
|---|---|---|---|
| 1,087,955 | 2/1914 | Knothe | 383/76 |
| 1,807,819 | 6/1931 | Altgelt . | |
| 1,832,696 | 11/1931 | Fleming . | |
| 1,955,346 | 4/1934 | Sherman | 294/69 |
| 1,971,395 | 8/1934 | Danner | 383/59 |
| 3,120,975 | 2/1964 | Tillman | 294/69 |
| 3,282,621 | 11/1966 | Peterson | 294/67 |
| 3,583,748 | 6/1971 | Arndt | 294/71 |
| 3,822,524 | 7/1974 | Jerpbak | 53/459 |
| 3,827,471 | 8/1974 | Gregory | 150/2 |
| 4,253,507 | 3/1981 | Williamson | 150/1 |
| 4,364,425 | 12/1982 | Mainville | 150/51 |
| 4,390,051 | 6/1983 | Cuthbertson | 383/67 |
| 4,480,766 | 11/1984 | Platt | 222/105 |
| 4,610,028 | 9/1986 | Nattrass | 383/17 |
| 4,715,635 | 12/1987 | Koskinen | 294/68.1 |
| 4,723,742 | 2/1988 | Krauss | 383/33 |
| 5,108,196 | 4/1992 | Hughes | 383/17 |
| 5,156,512 | 10/1992 | Suzuki et al. | 414/142.1 |
| 5,192,134 | 3/1993 | Polett | 383/24 |
| 5,201,446 | 4/1993 | Martin | 383/67 |
| 5,203,633 | 4/1993 | Derby | 383/17 |
| 5,340,218 | 8/1994 | Cuthbertson | 383/67 |
| 5,607,237 | 3/1997 | LaFleur | 383/22 |
| 5,738,443 | 4/1998 | Renaud | 383/67 |

OTHER PUBLICATIONS

Ameridig Inc.; Fabric Container (3pgs. Include Insert).

*Primary Examiner*—Stephen P. Garbe
*Attorney, Agent, or Firm*—Griffin, Butler Whisenhunt & Szipl, LLP

[57] ABSTRACT

A flexible fabric container having stiffening webbing attached to the outside thereof. At least one bottom flap is releasably attached to the bottom and is attached to the container by a quick release buckle that has a free portion, not attached to the container, to allow free movement of the quick release buckle upon actuation to release the bottom flap and allow the container to discharge the contents thereof.

7 Claims, 12 Drawing Sheets

Q
14a'
D
20
20b
20a
20c
15b
14
18
15a
20d
15
E

FLEXIBLE FABRIC CONTAINER

This is a divisional application of Ser. No. 08/733,987, filed Oct. 18, 1996 now U.S. Pat No. 5,738,443.

FIELD OF THE INVENTION

This invention relates to a material container which is flexible and which is comprised of at least one flap to allow for a bottom discharge of the container once it has been filled.

BACKGROUND AND OBJECTS OF THE INVENTION

Flexible fabric containers have a wide ranging application for the collection and distribution of a variety of objects, including materials excavated from street and utility construction, and the transloading of, for example, fish, fruits, and vegetables.

The prior art has attempted to meet these needs by a variety of containers, some of them flexible, others mounted on, or within, rigid frames.

In particular, because containers made of flexible materials—to conform the shape of the container to the particular materials loaded therein and to allow transport of unloaded containers in a compact manner—virtually always require either a permanent, or temporary, frame to serve as a device for maintaining an open top end into which the desired materials may be loaded. Thus, a container which has a permanent framework attached thereto is more expensive to construct, and a container which has a temporarily inserted frame—which must subsequently be removed—involves additional work and expense and slows the loading rate.

Accordingly, it is a primary object of this invention to provide a generally flexible fabric container which is self-standing, i.e. requires no frame, either permanent or temporary.

Those containers of the prior art which also need to have a bottom discharge capability, have achieved such a capability by allowing for an openable bottom, with the release mechanism consisting of simple strings or a variety of other devices. The chief disadvantage of the release devices of the prior art is either that they did not work reliably, or were not safe (because they could be discharged inadvertently when the loaded container was lifted to be transported to another location).

Accordingly, it is another primary object of this invention to provide a flexible fabric, container with a bottom discharge release mechanism that is failsafe under load, and which is reliable once the container has been safely lowered to ground level for discharge of its contents.

SUMMARY OF THE INVENTION

The foregoing and other objects, aspects, features, and advantages of the invention are achieved, in accordance with one aspect of the invention, by a frameless, self-standing, flexible fabric container having a frameless-rigidity sufficient to create an opening by folding the edges of the container over the outside thereof to create a self-standing container.

This feature of the invention is derived in part from the nature of the fabric of the container and in part from webbing stitched along the several sides of the container. The webbing serves several additional functions, as will be described below, at least one of which is to provide loops projecting above the container by which the container, once loaded with contents, may be lifted and transported to another location.

In one preferred embodiment of the invention, the webbing stitched along the sides of the container also serves as the anchoring points for a failsafe release mechanism by which the contents of the container may be discharged through an operable bottom flap.

In accordance with another object of the invention, the container may be constructed as an "open" container, i.e. one that can be assembled on site to create a container capable of holding a load. That is, the container may have several, preferably three, internal flaps which are folded from the respective sides of the container into the interior of the container, and at least one bottom flap to secure the bottom of the bag from discharge of its contents.

In accordance with another aspect of the invention, there is provided a lifting element which is designed to cooperate with the flexible bag to prevent collapse of the bag around its contents when the container is being lifted. This is of advantage when the contents of the container are comprised of soft or damageable contents such as for instance, fruits, vegetables, or even, fish.

The foregoing and other objects, aspects, features and advantages of the invention will be apparent from the following more particular description of several preferred embodiments of the invention, as illustrated in the accompanying drawings.

DETAILED DESCRIPTION

Figure 1:
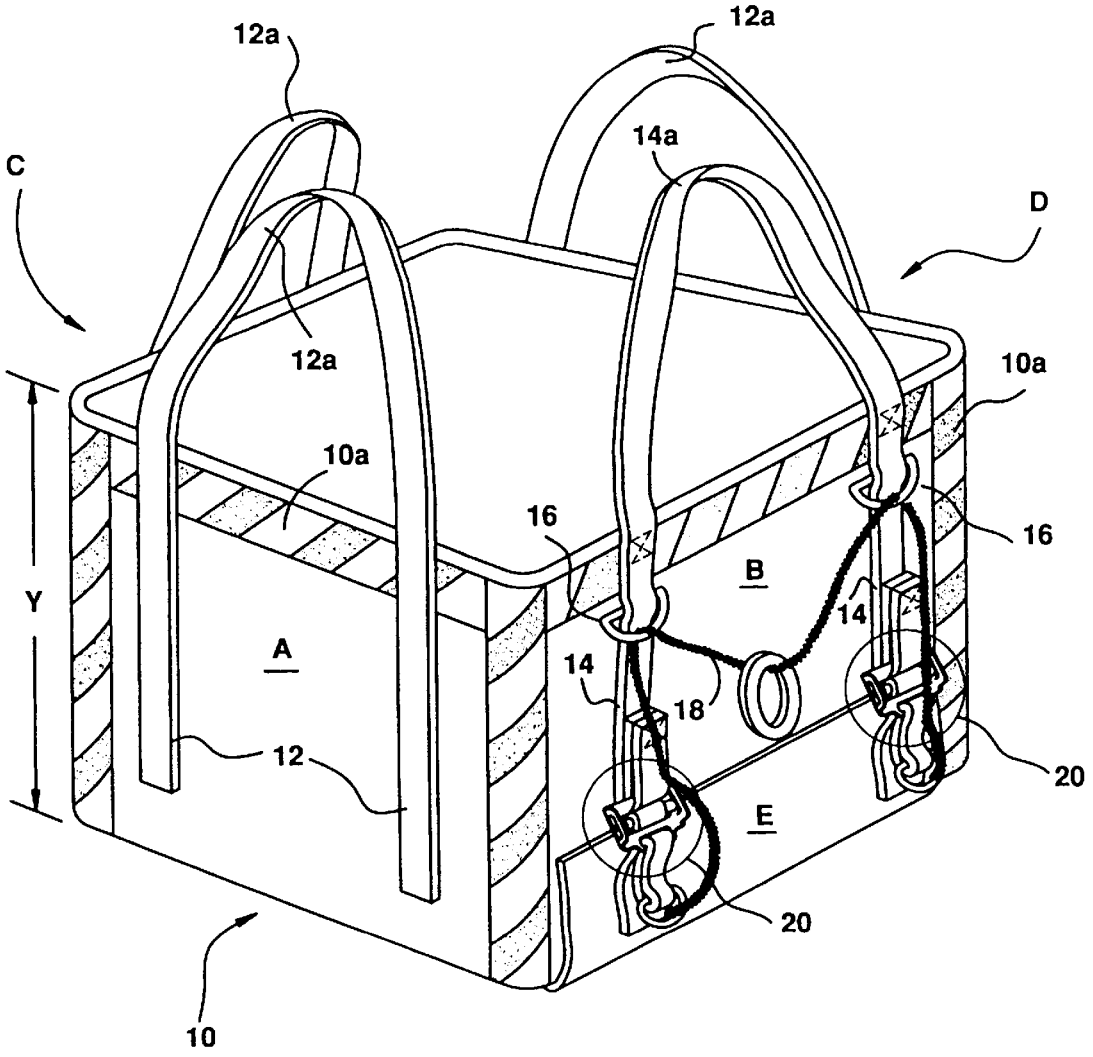
FIG. 1 shows a container in perspective view exposing two sides of the container.

With reference to FIG. 1, there is disclosed a fabric container 10, of a generally rectangular form and having four sides (or sidewalls) A, B, C and D. As will be shown below, the external view of sides C and D is identical to the side A shown in FIG. 1. Preferably, container 10 is comprised of a flexible, and preferably a porous, material having a minimum specific weight of 8.5 oz/sq. yd., having a minimum tensile strength of 400/400, a minimum trap tear of 125/125, a minimum burst strength of 750, a minimum puncture resistance of 150, all in accordance with the test methods performed in accordance with ASTM 4632, 4533, 3786, 4833 and D-1910. Polypropylene in accordance with specification "I-87" of the Amoco Corporation, the specification of which is attached hereto as Appendix "X", is one such material. While the container 10 may be made of a single layer fabric, for heavier uses, such as handling excavated street or utility materials, it is preferably made of a dual layer of material meeting the above specification. The container has a height "Y".

Container 10 has attached thereto, and along the sides thereof, fabric webbing (attachable, for example, by stitching) 12 which extend above the top edge of container 10 and formed into loops 12*a*.

The webbing 12 extends along substantially the entire height Y of the container 10. Container 10 also has on one of its sides, side "B", webbing 14 having a top loop 14*a*. As in the case of webbing 12, webbing 14 is attached to side "B" substantially along the entire height thereof.

FIG. 1 also illustrates a bottom flap "E" folded over side "B" of the container 10 and which is releasably attachable to a quick release mechanism comprised, in part, of loops, preferably made of metal, fastened to the webbing 14. A string, or rope, 18 passes through the loops 16 to provide a fulcrum for a quick release mechanism, shown generally at 20 (the details of which will be described below).

The webbing 12 and 14 can be made of any suitable material but is preferably made of a two inch wide, heavy weight multi-filament polypropylene material, with a preferred minimum thickness of 0.07 inches, and a minimum tensile strength of about 1125 pounds.

The substantially full extent of the webbing 12 and 14 along the height Y of the sides of the container 10 makes a substantial contribution to add stiffness to the sides of the container 10 to allow it to be self-standing, as will be described below. The prior art has shown flexible fabric containers in which the webbing has extended over generally less than 25% of the height Y of the container. In contrast therewith, the containers of the invention has the webbing extend over almost 90% of the height Y of the container, although it is believed that webbing, if of sufficient rigidity is used, need only extend about slightly in excess of 50% of the height Y of the container.

Figure 2:
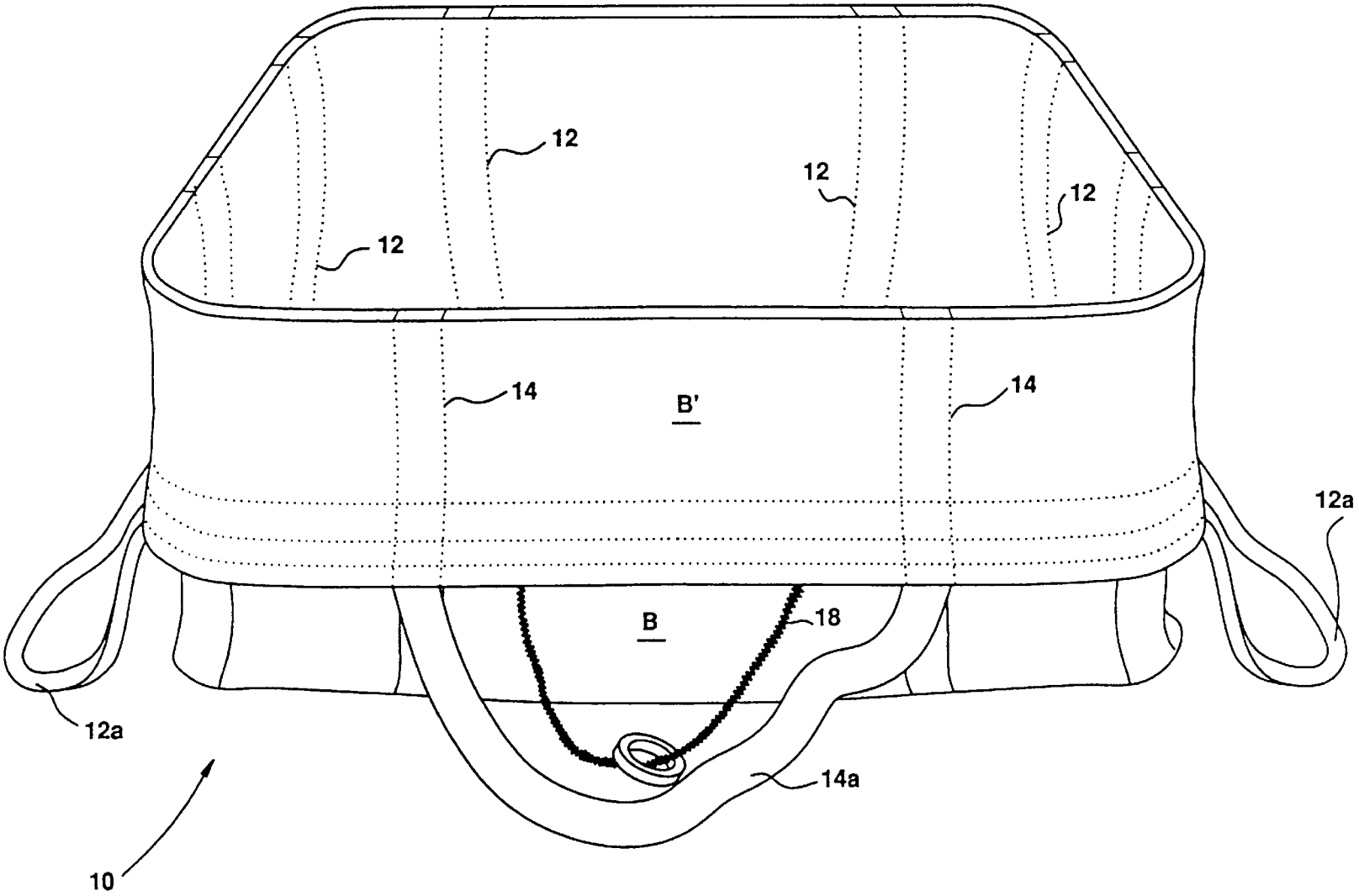
FIG. 2 shows the container with its upper edges folded over the sides thereof to create a self-standing container.

With reference to FIG. 2, there is shown the container 10 the sides of which have been folded over so that, for example, the interior side of side "B" is illustrated as "B'" folded over the perimeter of the container. The capability of the container 10 to be thus folded over its edges, to thereby create a self-standing structure, thereby eliminates the need for the insertion of a temporary frame inside the container, and totally eliminates the need for mounting the container 10 on a permanently attached framework.

As noted, the self-standing container is thus fully open to receive contents and once the contents reach the folded edges, the edges can be upturned to receive the remaining contents to the full extent of the now unfolded container.

Figure 3:
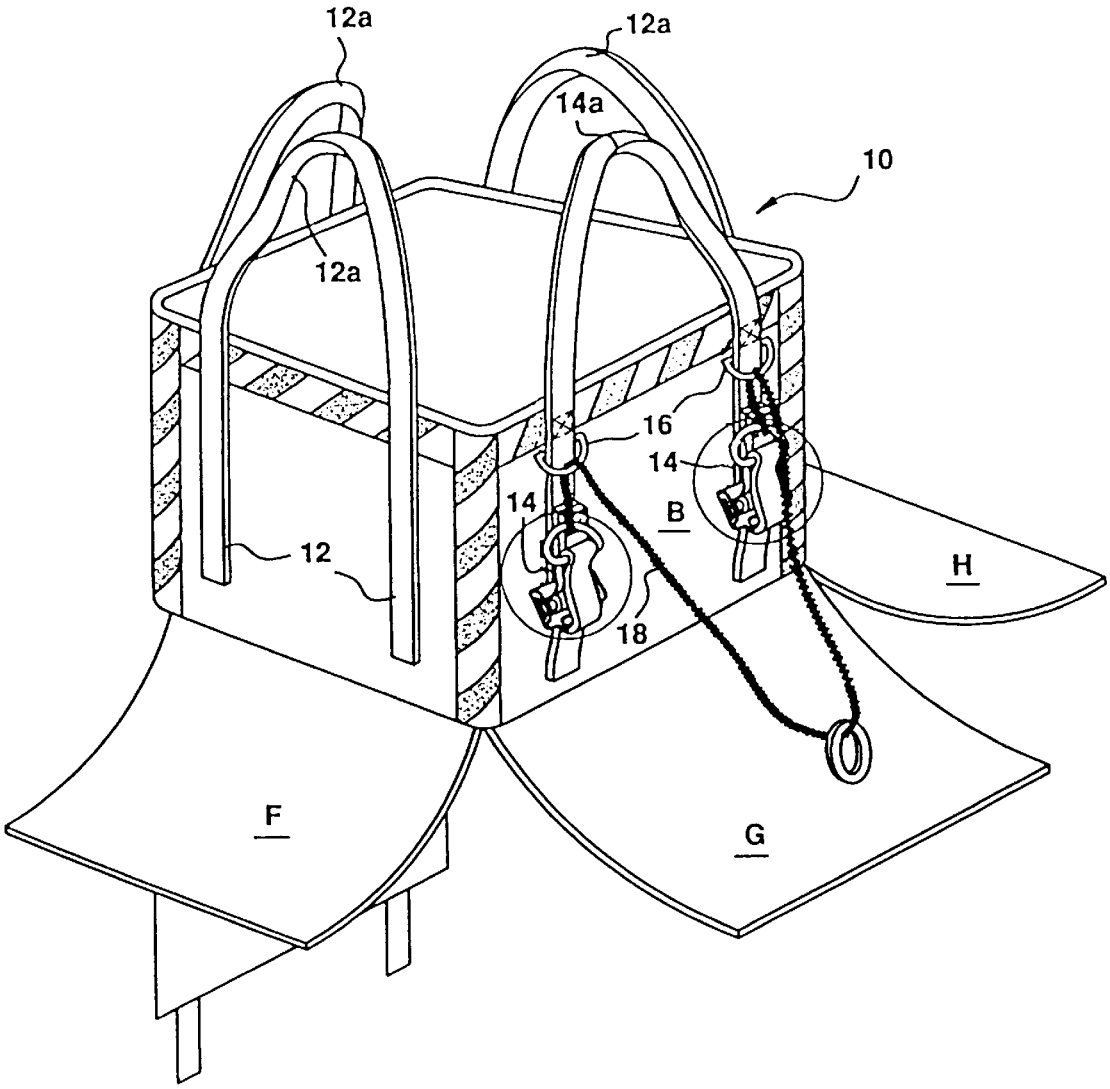
FIG. 3 shows the container with several flaps used to create a bottom of the container.

With reference to FIG. 3, parts previously shown in FIGS. 1 and 2 are numbered in the same way; however, FIG. 3 additionally discloses the base of container 10 as being comprised of a plurality of flaps "E", "F", "G" and "H". Flaps F, G and H, all of which form a part of the container 10 and are attached thereto, and made of the same fabric, and are designed to fold inwardly toward the interior of container 10. After inward folding of flaps F, G and H, the bottom flap E is folded around the bottom of the container 10 to partially overlap the bottom edge of side B of container 10. In this particular, preferred, embodiment, flaps F, G and H become "additional" bottom flaps, with flap E being the bottom most flap.

Figure 4:
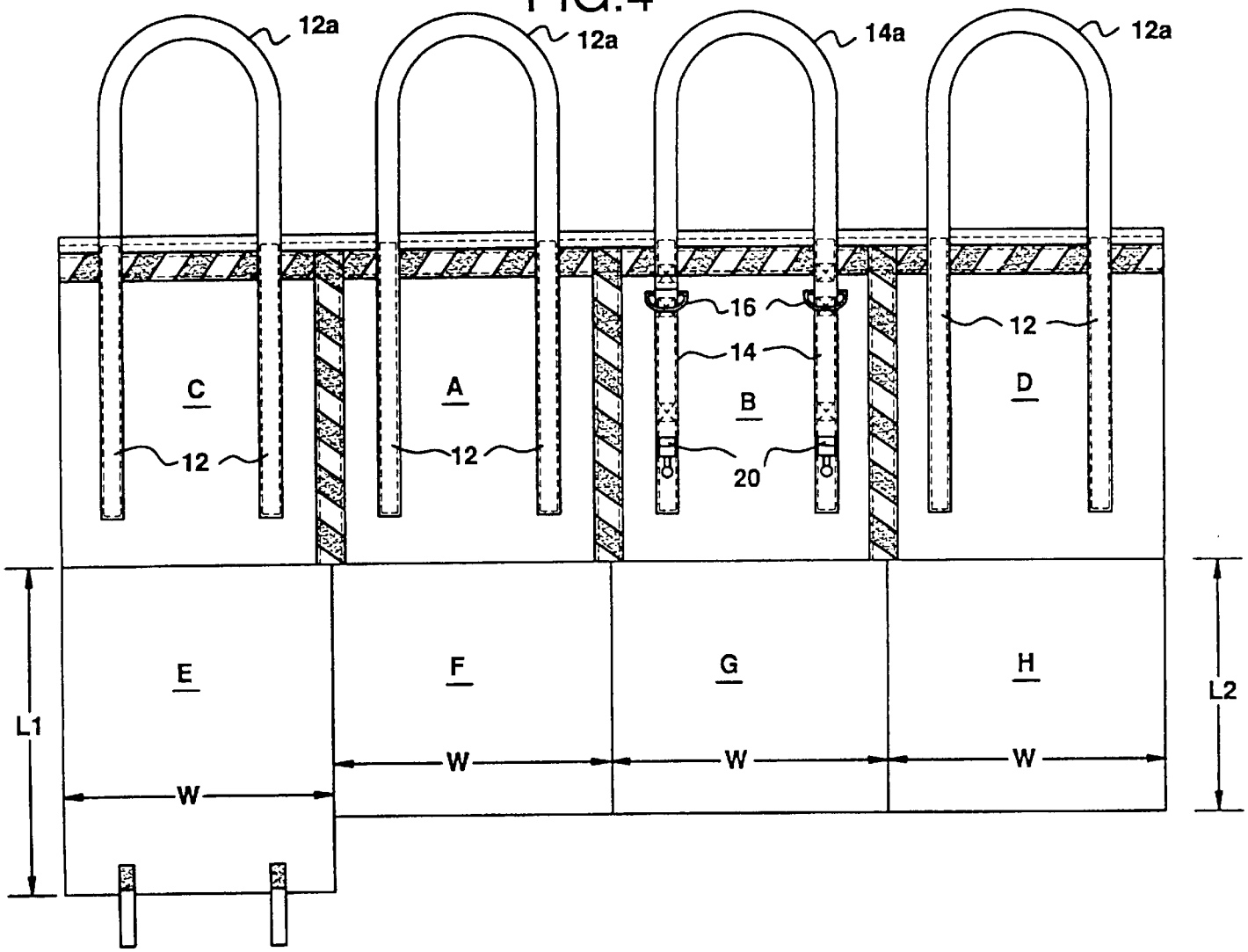
FIG. 4 shows a folded-out view of the container, illustrating all four sides thereof with an embodiment that utilizes three internal flaps, in addition to the bottom flap.

With reference to FIG. 4, there is illustrated the various sides of container 10 and flaps in a "fold-out" pattern. In addition to showing further details, previously described generally, it is noted that bottom flap "E" has a longer dimension L1 than flaps F, G and H which show the same length L2. When flaps F, G and H are folded into the interior of the bag, they will fit inside thereof and bottom flap E will be able to fold around the bottom edge of side B as shown in FIG. 1. As also shown in FIG. 4, flaps F, G and H have the same width W so as to fit, when folded into the interior of container 10, within the inside thereof. It is to be noted that the width of bottom flap E is also W.

Figure 5:
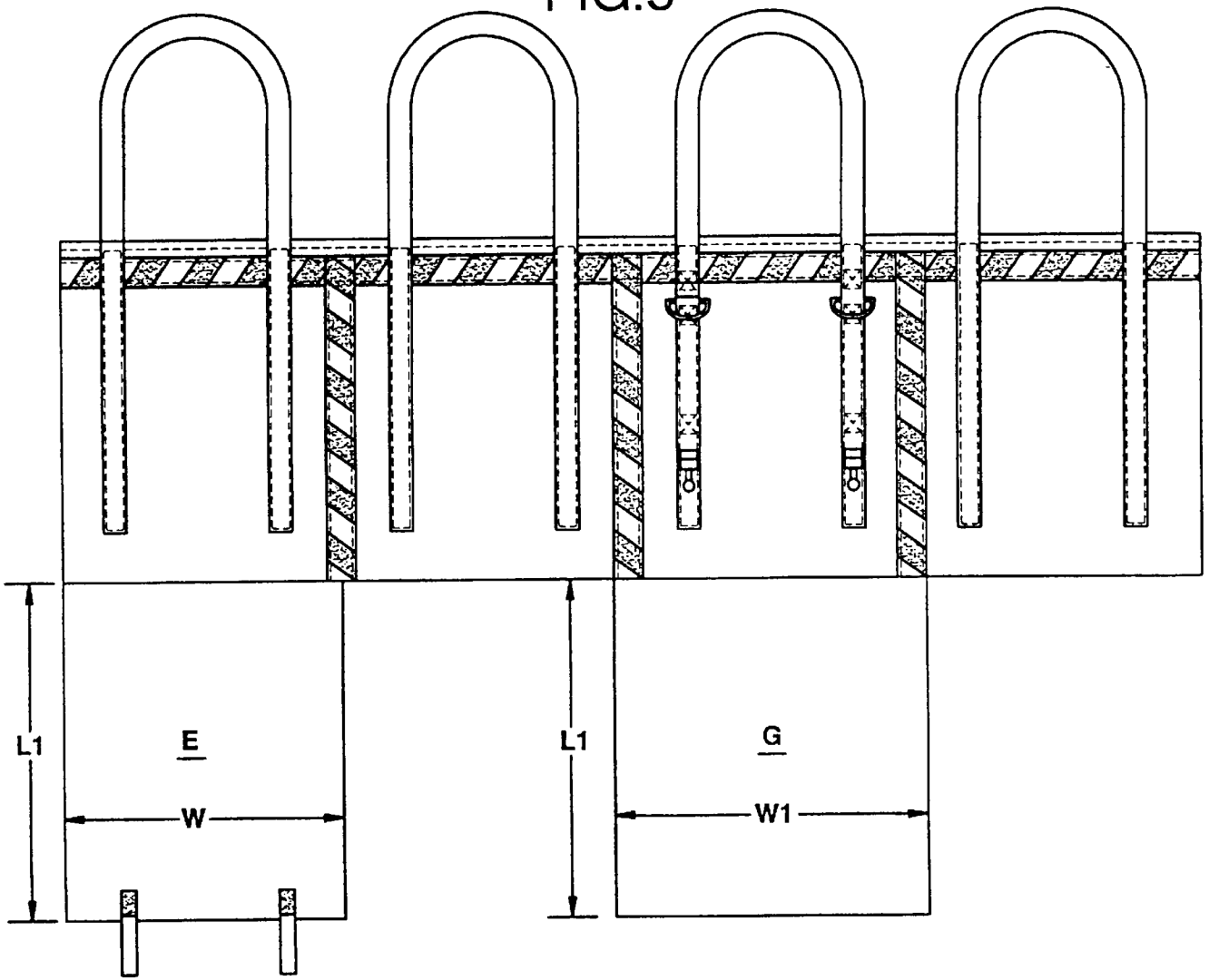
FIG. 5 shows another embodiment of the invention illustrating a container having only one internal flap in addition to the bottom flap.

With reference to FIG. 5, previously identified parts in other figures have not been renumbered. However, FIG. 5 shows an embodiment with only one internal flap, e.g. "G" in which, unlike the embodiment shown in FIG. 4, the interior flap "G" has the same length L1, as the bottom flap "E". The width, W1, of flap "G" is slightly larger than the width "W" of the bottom flap "E". With a single internal flap "G" embodiment of the invention, the dimensions of the internal flap "G", that is its length, L1 and its width W1, allow for the edges of flap "G", when folded inside the container, to curl up around the edges thereof to provide a leak proof capability.

Figure 6:
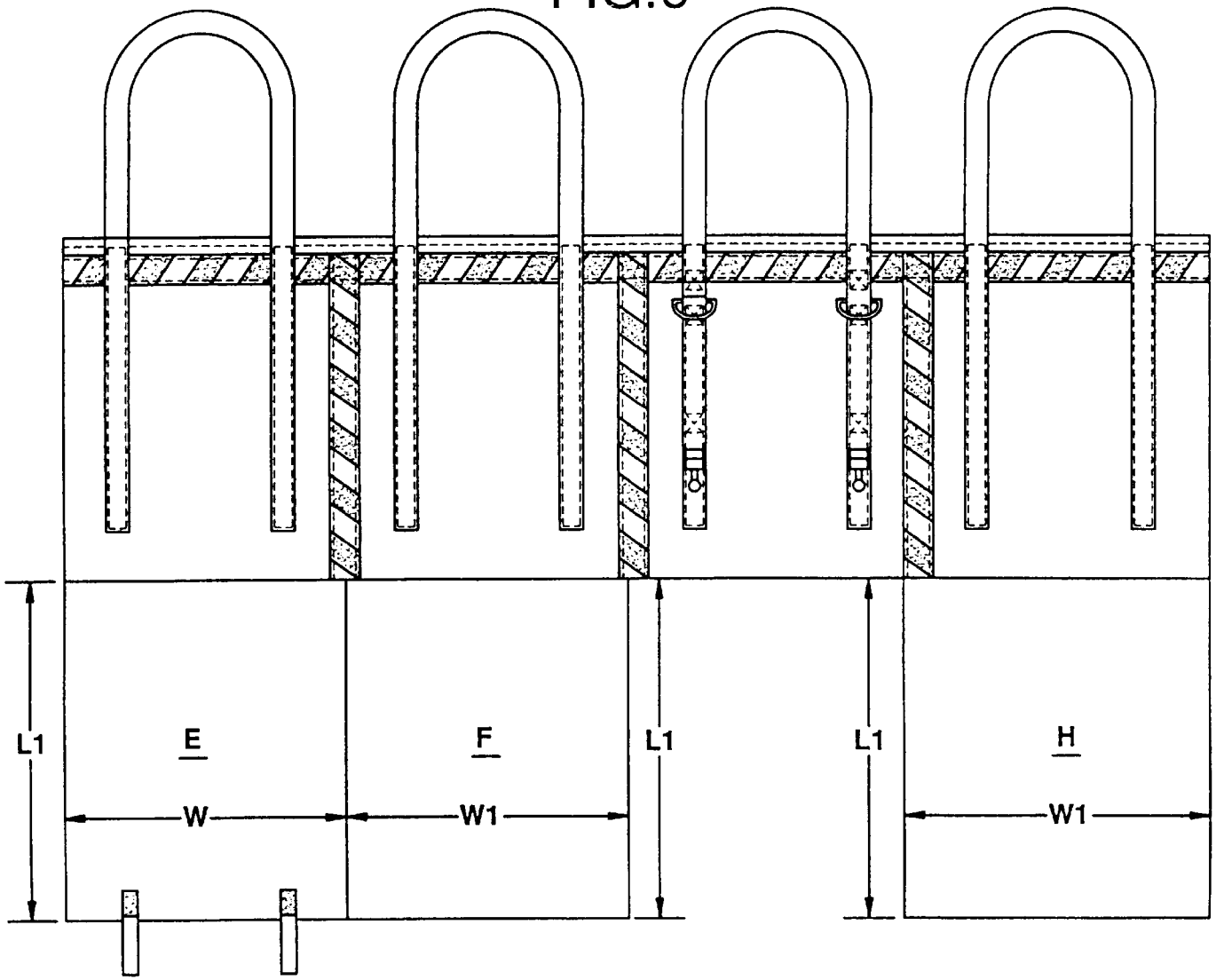
FIG. 6 shows an embodiment of the invention which utilizes two internal flaps, in addition to the bottom flap.

In FIG. 6, an embodiment of the invention is disclosed which utilizes two internal flaps F and H in addition to the bottom flap E. Again, as with the embodiment of FIG. 5, the dimensions of the internal flaps F and H are identical in length to the bottom flap E but with a wider width W1 than the width W of bottom flap E.

Figure 7:
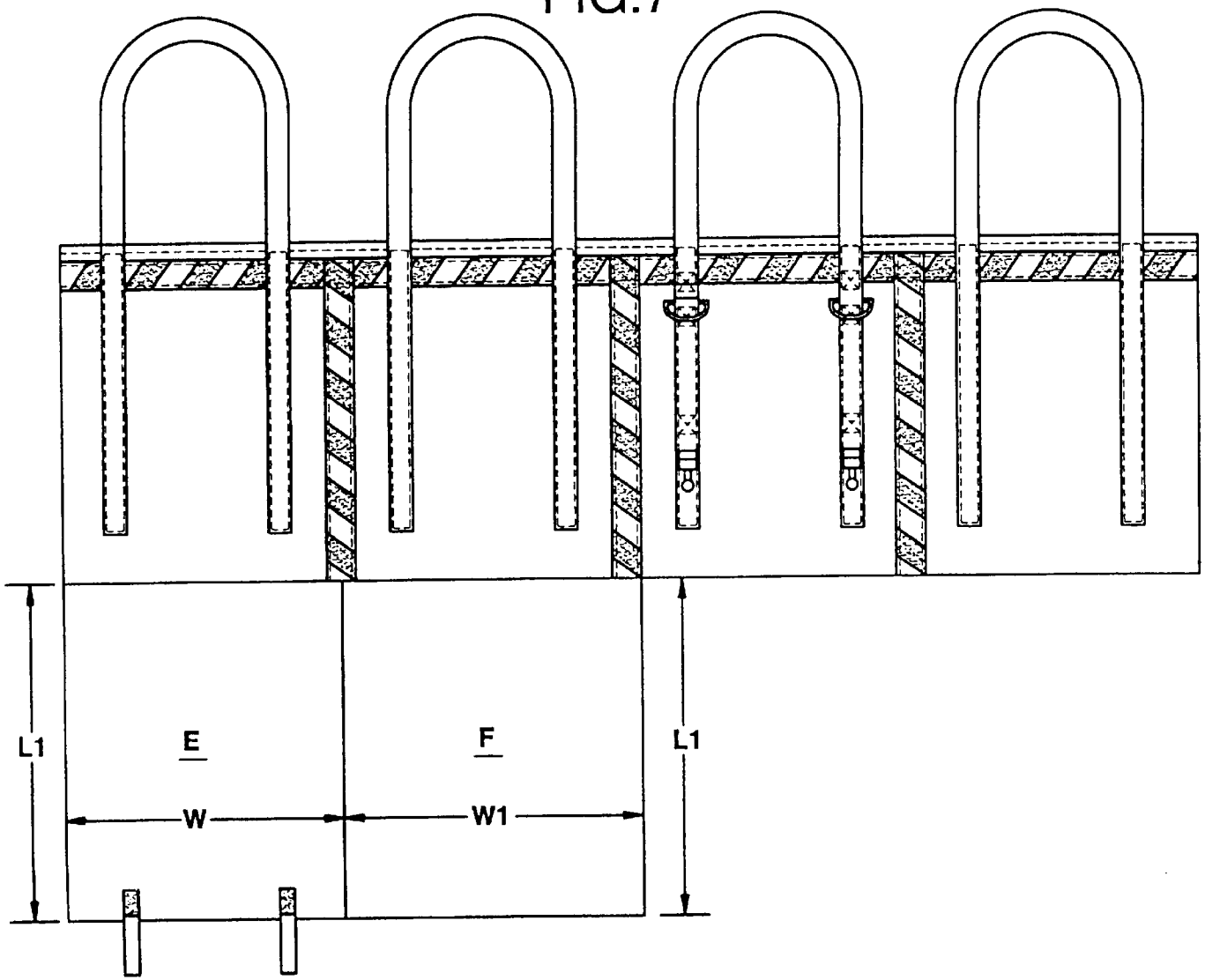
FIG. 7 shows an embodiment of the invention in which only one internal flap, in addition to the bottom flap, is utilized.

The embodiment shown in FIG. 7 is again an embodiment similar to the embodiment shown in FIG. 5 in that only one internal flap "F" is shown, in addition to the bottom flap E. Again, as in the previous embodiments, of FIGS. 5 and 6, the internal flap F has the same length, L1 but a slightly wider width W1 than the width W of the bottom flap E.

Figure 8:
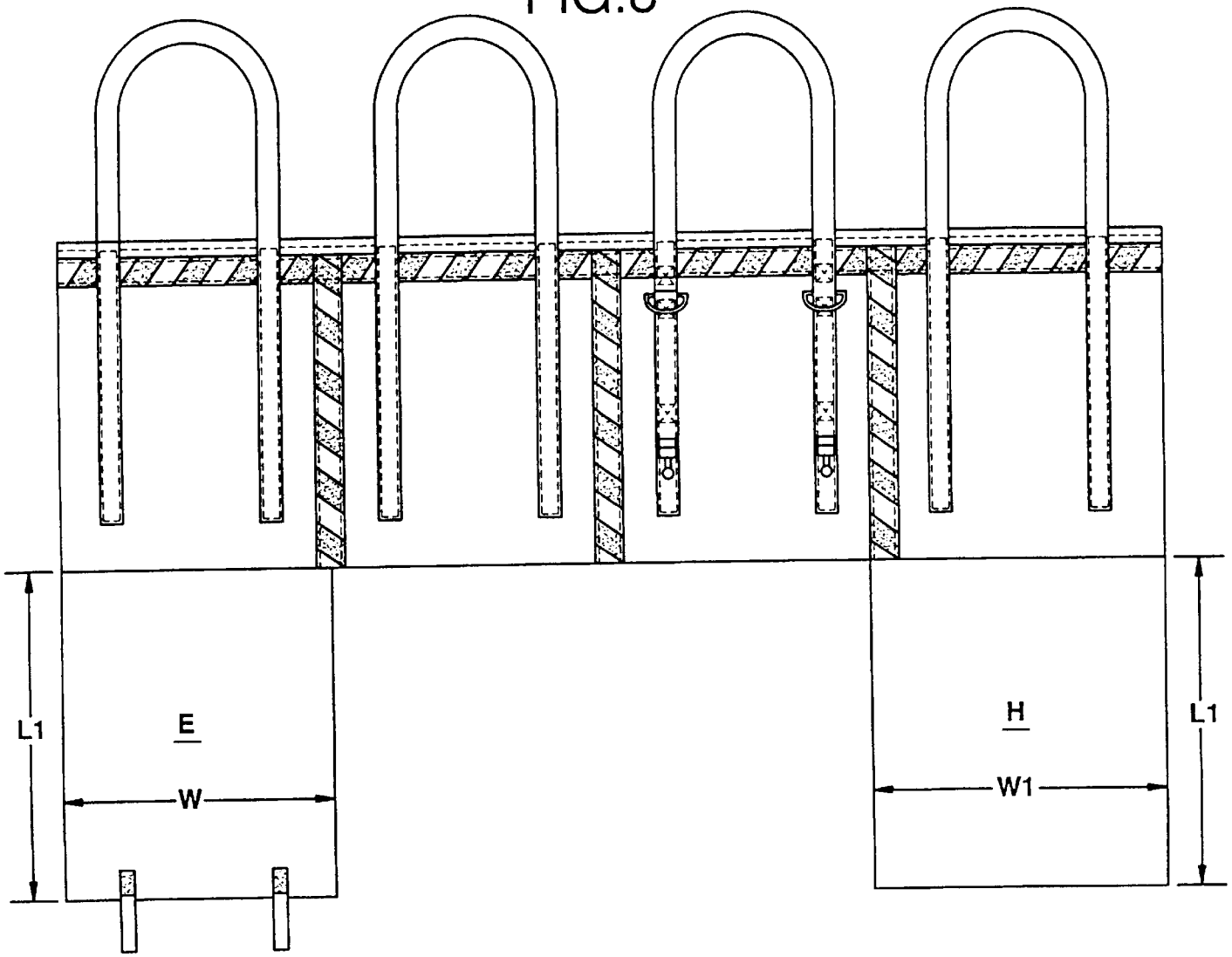
FIG. 8 shows another embodiment of the invention showing another version with only one flap in addition to the bottom flap.

FIG. 8 shows another embodiment in which only one internal flap H is used with the same dimensioning, with respect to the bottom flap E as discussed with respect to the embodiments shown in FIGS. 5, 6, 7 and 8.

Figure 9:
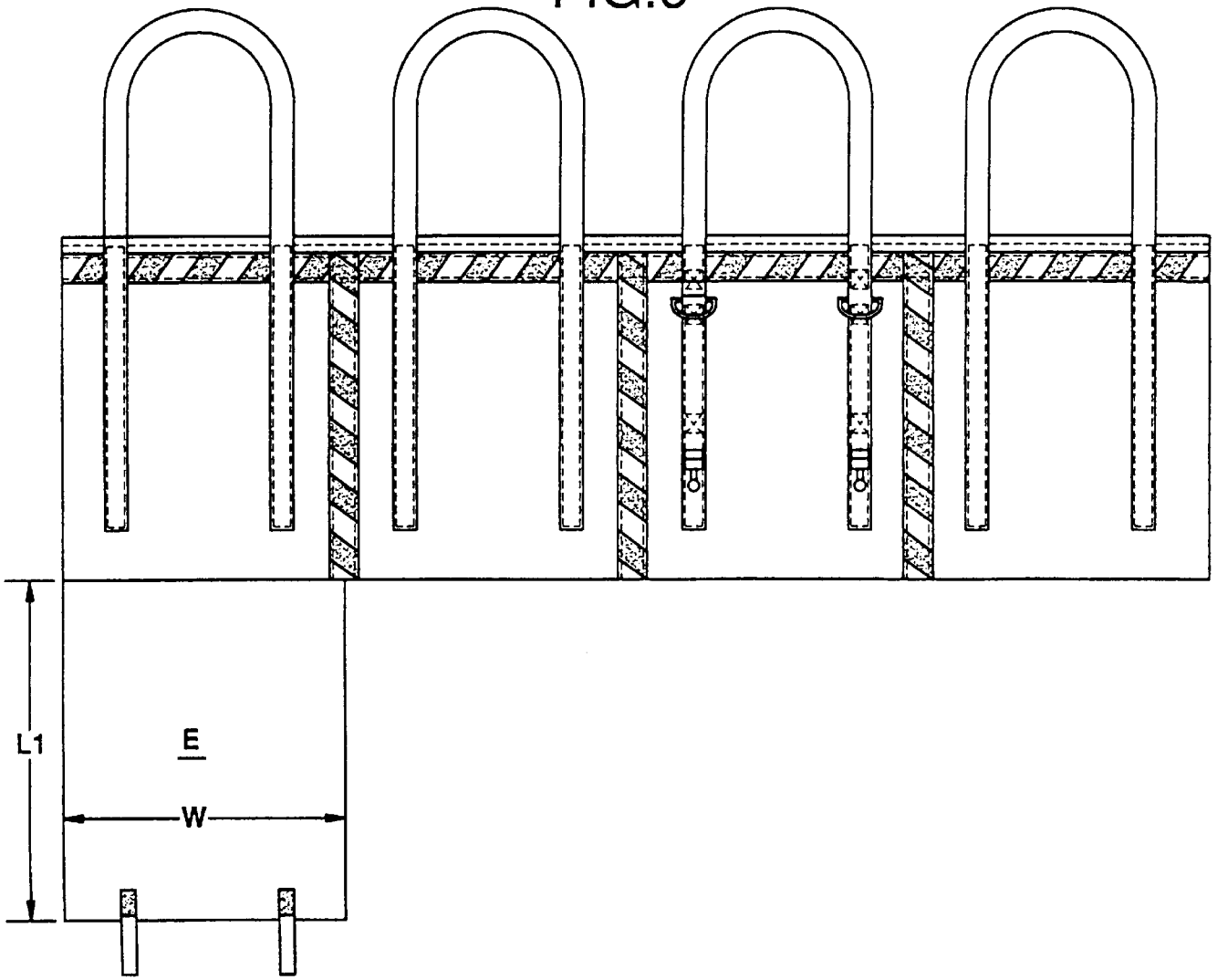
FIG. 9 shows an embodiment of the invention utilizing only one bottom flap.

With reference to FIG. 9, there is shown an embodiment of the invention utilizing only one bottom flap E and no internal flaps. As with all embodiments of the invention showing the bottom flap E, its length L1 is such that the bottom flap E can be curved around the edge of the container 10, as shown in FIG. 1.

Figure 10:
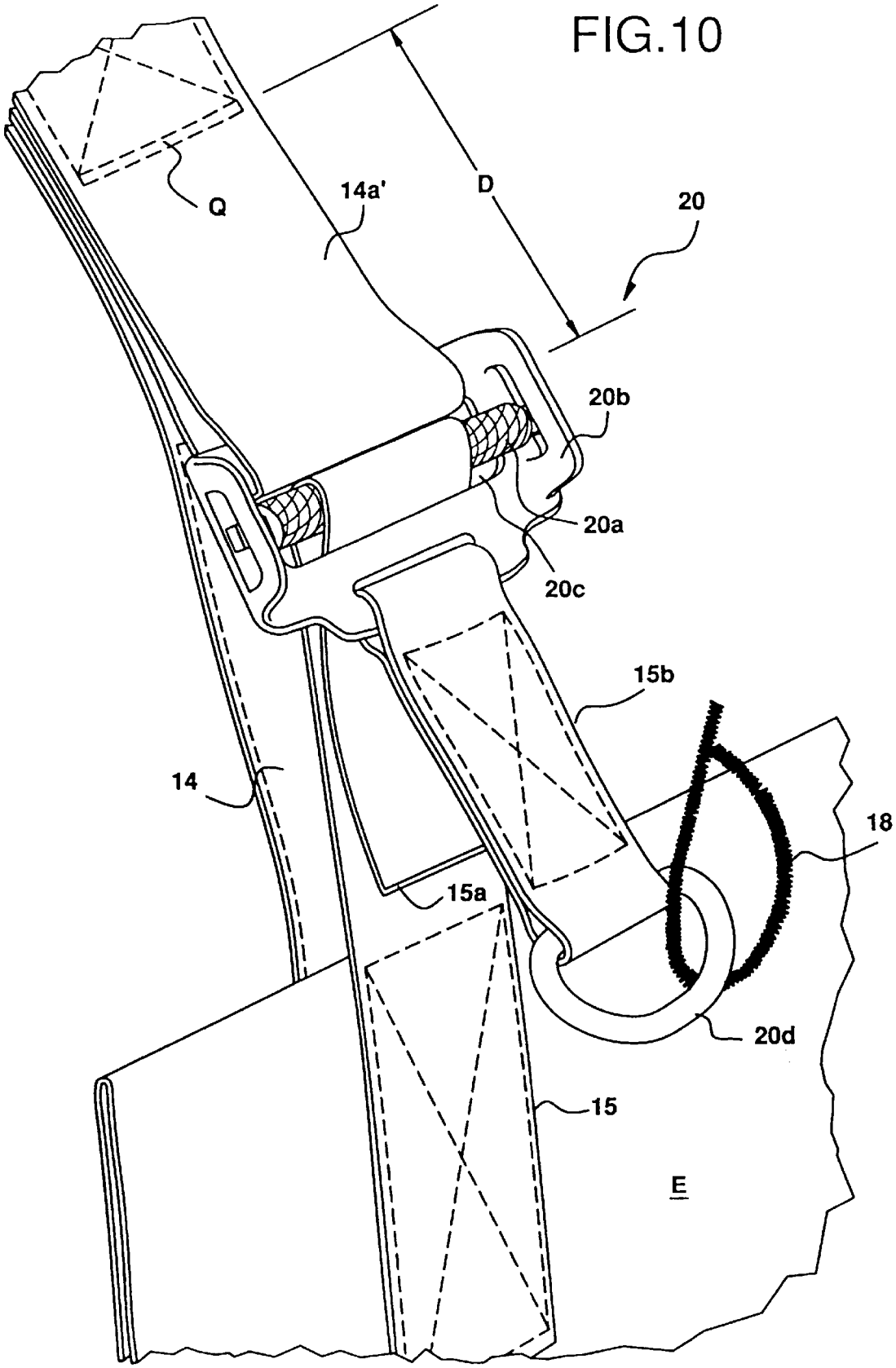
FIG. 10 illustrates details of the quick-release safety mechanism utilized in the invention.

With reference to FIG. 10, there is shown the further details of the quick release assembly 20, previously described with respect to FIG. 1. Briefly described, the bottom flap E has attached, or stitched, thereto a flap 15, the end 15*a* of which is passed through and over a sliding bar 20*a* of the quick release assembly 20. Quick release assembly 20 further has a metal housing 20*b* and a slot 20*c* through the later of which end of flap 15*a* passes in its way over the bar 20*a*.

Webbing 14 has a separately stitched portion 14*a'* which loops around the quick release assembly 20 to secure quick release of assembly 20 against motion. The important feature of FIG. 10 is that there is a free end, of a length D, of webbing stitched potion 14*a'* 14*a* (not attached to the sides of container 10) which allows the quick release assembly 20 to move, or rotate, about the attachment point Q of a flap of webbing stitched portion 14*a*. This allows a reliable release of the quick release assembly 20 so that it can rotate about Q along the length of webbing 14 when a pull cord 18 (see FIG. 1) is pulled through buckles 16 and 20*d*.

Thus, when container 10 is loaded with contents, the quick release buckle 20 places flap 15*a* under tension through the action of bar 20*a* and the quick release buckle 20 functions as a self-tightening safety strap to prevent the contents from being discharged.

Once the loaded container 10 is placed on a supporting surface, the tension of flap 15*a* and the buckle 20 is released so that a tug on cord 18 can "pull up" the quick release buckle 20 because the free distance D gives buckle 20 the ability to do so.

Figure 11:
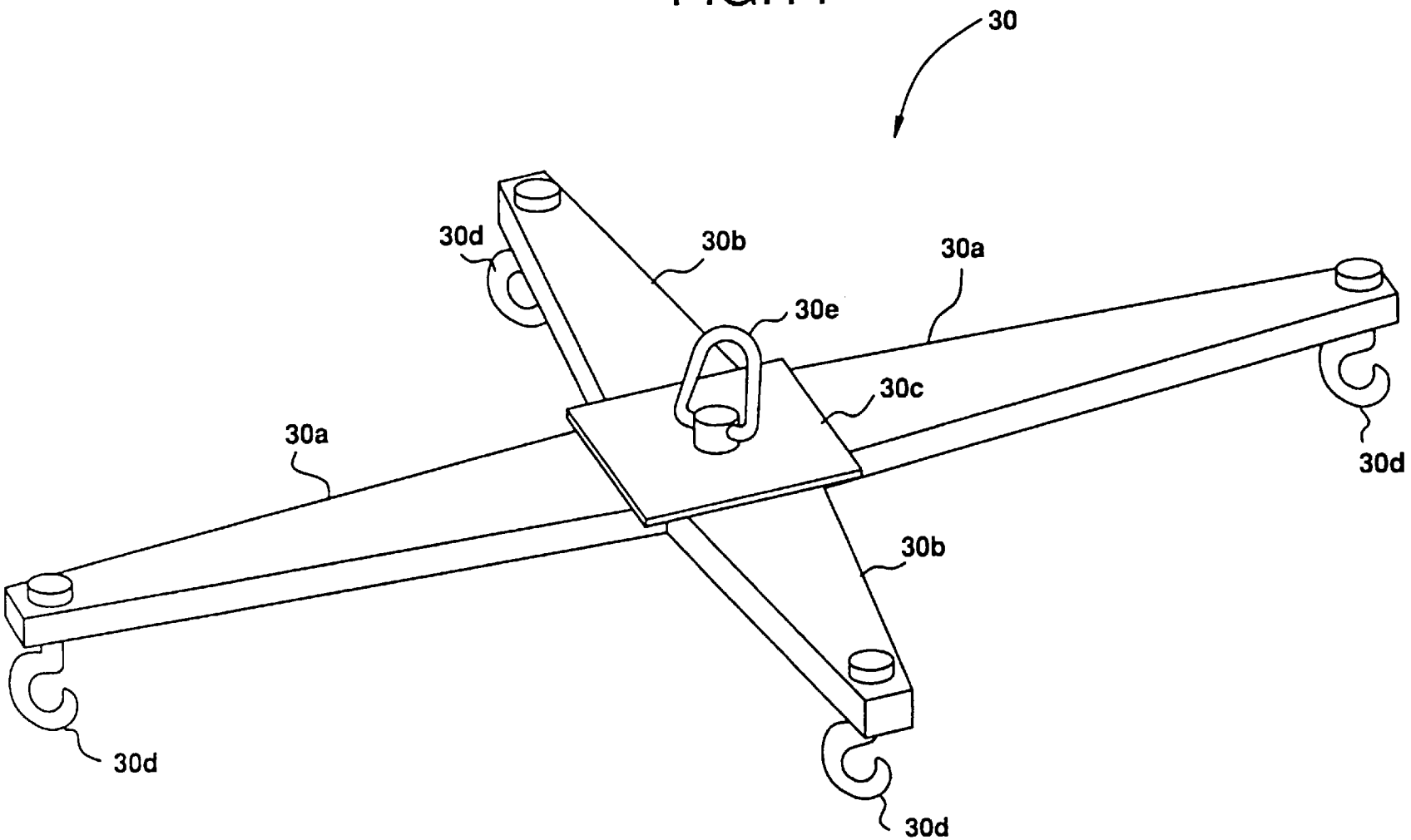
FIG. 11 shows a lifting arrangement for lifting the container when it is loaded with easily damageable products such as fruits, vegetables, or the like; and, FIG. 12 shows an embodiment of the invention in which the container is substantially cylindrical.

With reference to FIG. 11, there is shown a lifting attachment 30 which is preferred for use when the container 10 contains relatively soft contents, such as fruits, vegetables, or fish. When lifting container 10 is filled with such loads, squeezing of the contents of the flexible fabric of container 10 should be minimized. This is achieved by a structure which includes two transverse cross bars 30*a* and 30*b* which are fastened together (by conventional means) through a fastening plate 30*c*. At each end of the respective transverse cross bars 30*a* and 30*b* there are lifting hooks 30*d* designed to engage the several loops 12*a*, and 14*a* (see FIG. 1) of container 10. A lifting hook 30*e*, attached (by conventional means) to the lifting attachment 30 allows a loaded container 10 to be lifted without squeezing in the sides thereof and thereby eliminating the squeezing of fragile contents loaded in container 10. In affect, the lifting bar 30 spreads container 10 to prevent squeezing of the contents thereof.

With reference to FIG. 1, the container 10 optionally may have bright color or reflective markings 10*a* fastened, or stitched, around the perimeter of container 10, and along the sides thereof. Such a bright or reflective marking of container 10 is useful when container 10 is used to store excavated earth work materials adjacent to, for example, an open utility trench. The bright or reflective markers 10*a* serve to alert passers-by of both the presence of the containers and the existence of construction work.

Figure 12:
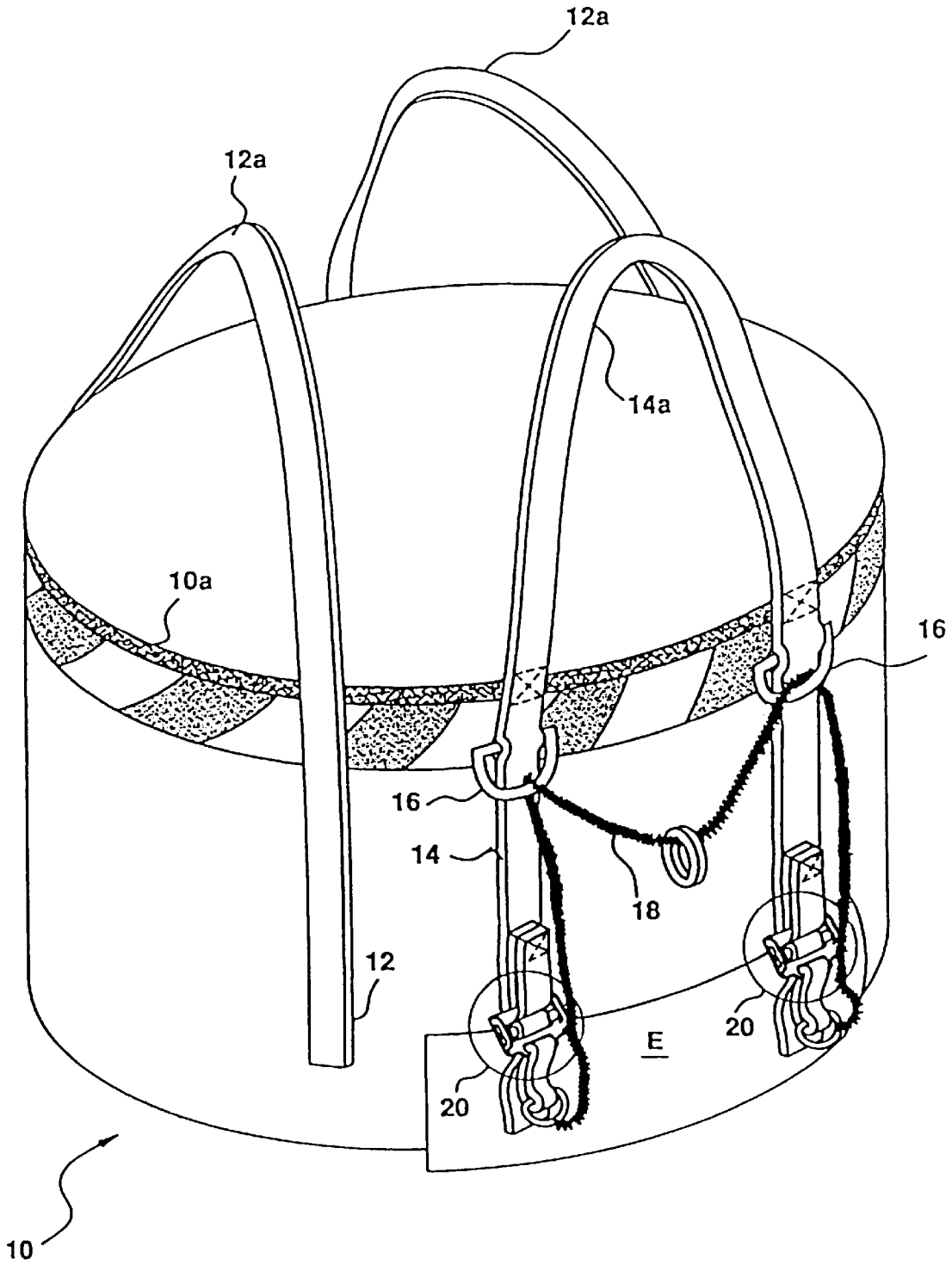

With reference to FIG. 12, there is shown another embodiment of the invention in which the container 10 has an essentially circular form, as opposed to the generally rectangular form illustrated in FIG. 1. Corresponding parts are numbered as in the previous figures; that is, webbing 12 extends along substantially the entire height of the container 10 and exhibits loops 12*a* spaced generally equally around the periphery thereof. Webbing 14 also extends along substantially the entire height of the container 10 and has a loop 14*a*. Webbing 14, attached or stitched to container 10, secures loops 16 through which pass a releasing rope 18 to release a quick release lock 20, as previously illustrated in FIG. 10. The container 10 also reflects an appropriately shaped bottom flap E which folds over the sides of container 10 to secure whatever contents may be loaded into container 10. Container 10 also exhibits bright or reflective tape, or markers, 10*a* fastened, or stitched to, the periphery of container 10. Thus, the embodiment disclosed in FIG. 12 achieves all of the features, and shares the aspects, of the several embodiments disclosed in FIGS. 1 through 11. While the embodiment shown in FIG. 12 shows three loops, 12*a* and 14*a* spaced generally equally around the periphery of container 10, a container may also be made with only two loops, one of which would be loop 14*a* and only one loop 12*a*, generally spaced about 180 degrees from loop 14*a* around the perimeter of container 10, as shown in FIG. 12.

While the invention has been particularly shown and described with reference to preferred embodiments thereof, it will be understood by those skilled in the art that the foregoing and other changes in form and details may be made therein departing from the spirit and scope of the invention.

What is claimed:

1. A flexible fabric container for being loaded with bulk material, lifted by machinery, and activated to release the bulk material, said container comprising:

an upright, closed, perimeter sidewall defining upper and lower open ends of the sidewall and a releasable bottom flap attached along a lower edge of the sidewall for selectively covering the lower open end, said sidewall being constructed of a flexible fabric;

elongated straps fastened to the sidewall of the container, at least some of said straps forming handle loops, said handle loops adapted to be engaged by machinery for lifting the container, said elongated straps being constructed of a flexible material;

the bottom flap being rotatable at its attachment with the lower edge of the sidewall between an uncovering position in which it uncovers substantially the entire lower open end of the sidewall for discharging material from the container and a covering position in which it covers substantially the entire lower open end of the sidewall for retaining material in the container;

at least one self-tensioning buckle assembly attached to the sidewall, each self-tensioning buckle assembly including a release buckle;

elongated flap straps, each having a first portion attached to the flap and an opposite, free, second end portion for passing through one of the release buckles;

wherein said buckle assembly comprises said self-tensioning release buckle and a buckle strap loop, said buckle strap loop being attached to the sidewall and having a non-attached, free loop portion extending away from the attachment encircling a part of the release buckle, wherein the length of the free loop portion is sufficient to allow it, and the release buckle it encircles, to be easily rotated upwardly, away from the sidewall, for allowing the release buckle to release the free, second, end portion of the flap strap, thereby releasing the bottom flap to allow the container to discharge its contents.

2. A flexible fabric container as in claim 1 wherein the fabric forming the sidewall and a material forming the straps are of sufficient weight and stiffness so that the sidewall, when an upper edge portion of the sidewall is folded over on an outside surface of the sidewall, is substantially-vertically self-standing on a surface even when it is not loaded with material.

3. A flexible fabric container as in claim 2 wherein the fabric forming the sidewall is formed of dual layers of material.

4. A flexible fabric container as in claim 1 wherein said buckle strap loop is formed of a strap having overlapping ends attached to the sidewall.

5. A flexible fabric container as in claim 1 wherein said release buckle is rotated for allowing the release buckle to release the free, second, end portion of the flap strap when the container is placed on a supporting surface, thereby allowing the container to discharge its contents when the container is lifted from the supporting surface.

6. A method of removing bulk materials comprising the steps of:

providing a flexible fabric container for receiving a load of the bulk materials, said flexible fabric container comprising:

an upright, closed perimeter sidewall defining upper and lower open ends of the sidewall and a releasable bottom flap attached along a lower edge of the sidewall for selectively covering the lower open end, said sidewall being constructed of flexible fabric;

elongated straps fastened to the sidewall of the container, at least some of said straps forming handle loops, said handle loops adapted to be engaged by machinery for lifting the container, said straps being constructed of flexible material;

the bottom flap being rotatable at its attachment with the lower edge of the sidewall between an uncovering position in which it uncovers substantially the entire lower open end of the sidewall for discharging material from the container and a covering position in which it covers substantially the entire lower open end of the sidewall for retaining material in the container;

at least one release assembly for being attached between the sidewall and the bottom flap for holding the bottom flap in the covering position and for being selectively activated to allow the bottom flap to move to the uncovered position;

Constructing the perimeter sidewall and straps of material having sufficient weight and stiffness that the sidewall has sufficient rigidity that the sidewall, is substantially-vertically self-standing when an upper end edge portion of the sidewall is folded over on an outside surface, thereof:

folding the upper edge portion of the sidewall over on the outside surface of the sidewall and standing the sidewall upright;

while the sidewall is standing upright, loading the container from above with the bulk materials until the sidewall, with the folded-over upper edge portion, is substantially full and then raising the upper edge portion upwardly;

further loading the container with the bulk materials through the sidewall open upper end; and lifting the container by the handle loops with machinery for removing the bulk materials.

7. A method as in claim 6 wherein said bottom flap has an overlap portion for, when said bottom flap is in the covering position, overlapping a lower bottom edge portion of the sidewall, opposite the attachment of the bottom flap along the lower edge of the sidewall.

* * * * *